US008770508B2

(12) United States Patent
Tenpaku et al.

(10) Patent No.: US 8,770,508 B2
(45) **Date of Patent: *Jul. 8, 2014**

(54) RECORDING APPARATUS AND ROLL PAPER LIFTING DEVICE

(75) Inventors: Hisashi Tenpaku, Matsumoto (JP); Seijun Horie, Matsumoto (JP); Takuya Yasue, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 230 days.

This patent is subject to a terminal disclaimer.

(21) Appl. No.: 13/252,607

(22) Filed: Oct. 4, 2011

(65) Prior Publication Data

US 2012/0091250 A1 Apr. 19, 2012

(30) Foreign Application Priority Data

Oct. 15, 2010 (JP) ..... 2010-232254
Nov. 1, 2010 (JP) ..... 2010-245223
Nov. 1, 2010 (JP) ..... 2010-245225

(51) Int. Cl.
*B65H 19/22* (2006.01)

(52) U.S. Cl.
USPC ..... 242/533; 242/559.4

(58) Field of Classification Search
USPC ..... 242/533, 588, 559, 559.3, 559.4, 561, 242/557
See application file for complete search history.

(56) References Cited

U.S. PATENT DOCUMENTS 3,325,120 A * 6/1967 Brinkman ..... 242/557
4,154,470 A 5/1979 Dalglish
4,824,313 A * 4/1989 Miller ..... 414/346
5,253,972 A * 10/1993 Drew et al. ..... 414/469
5,524,415 A * 6/1996 Pachinger et al. ..... 53/203
6,299,100 B1 * 10/2001 Cloud ..... 242/598.5
7,360,740 B2 * 4/2008 Reagan et al. ..... 242/596.1
2004/0011914 A1 1/2004 Gandini
2009/0104007 A1 4/2009 Umezawa
2009/0242603 A1 10/2009 Kobayashi et al.
2012/0187233 A1 * 7/2012 Tenpaku et al. ..... 242/590
2013/0043340 A1 * 2/2013 Tenpaku et al. ..... 242/598.2

FOREIGN PATENT DOCUMENTS

CN 101412490 4/2009
GB 2175572 12/1986
JP 6-340357 12/1994
JP 2004-509036 3/2004
JP 2009-023171 2/2009
JP 2009-234668 10/2009

OTHER PUBLICATIONS

U.S. Appl. No. 13/347,826, Sep. 9, 2013, Office Action.
U.S. Appl. No. 13/347,826, Aug. 15, 2012, Final Office Action.

* cited by examiner

*Primary Examiner* — Sang Kim
(74) *Attorney, Agent, or Firm* — Workman Nydegger

(57) ABSTRACT

A recording apparatus includes a roll paper holder including a shaft portion which holds a roll paper such that the roll paper is capable of being fed, a temporal placement portion on which the roll paper is temporarily placed, and a roll paper lifting device which includes a placement portion on which the roll paper is placed, and lifts the roll paper to a height position of the shaft portion of the roll paper holder while an end of the roll paper in the temporarily placed state is placed on the placement portion so as to position a core port of a roll core of the roll paper and the shaft portion.

6 Claims, 11 Drawing Sheets

RECORDING APPARATUS AND ROLL PAPER LIFTING DEVICE

INCORPORATION BY REFERENCE

The entire disclosure of Japanese Patent Application Nos. JP2010-232254, JP2010-245223 and JP2010-245225 filed on Oct. 15, 2010, Nov. 1, 2010 and Nov. 1, 2010 respectively is expressly incorporated by reference herein.

BACKGROUND

1. Technical Field

The present invention relates to a recording apparatus and a roll paper lifting device. The recording apparatus includes a roll paper holder which includes a shaft portion holding a roll paper such that the roll paper is capable of being fed and a temporal placement portion on which the roll paper is temporarily placed before the roll paper is mounted on the roll paper holder.

2. Related Art

In a recording apparatus such as a large-sized ink jet printer, since a roll paper is heavy, the roll paper is once placed on a temporal placement table of the recording apparatus, and then, the roll paper is mounted on a roll paper holder attached to the recording apparatus, as described in JP-A-2009-23171.

In the existing technique, the roll paper is placed on the temporal placement table, and then, a user manually lifts the roll paper by approximately 2 to 5 cm to a height position of a shaft portion of the roll paper holder and positions a core port of a roll core and the shaft portion. Thereafter, the user horizontally slides the roll paper holder in the axial direction to mount the shaft portion on the core port.

However, there are roll papers of which weights are as heavy as 20 to 30 kg, further 40 kg, and up to 50 kg. With the increase in the weight of the roll paper, a problem has arisen that, because a manual lifting operation of the roll paper is left to a user, the user is forced to do hard labor as lifting a heavy roll paper.

SUMMARY

An advantage of some aspects of the invention is to provide a technique of mounting a roll paper on a roll paper holder without requiring a user to do hard labor even when the roll paper of which weight is heavy is used in response to increase in weight of the roll paper.

A recording apparatus according to a first aspect of the invention includes a roll paper holder including a shaft portion which holds a roll paper such that the roll paper is capable of being fed, a temporal placement portion on which the roll paper is temporarily placed, and a roll paper lifting device which includes a placement portion on which the roll paper is placed, and lifts the roll paper to a height position of the shaft portion of the roll paper holder while an end of the roll paper in the temporarily placed state is placed on the placement portion so as to position a core port of a roll core of the roll paper and the shaft portion. In the recording apparatus, the roll paper lifting device includes an elevating/lowering portion (hereinafter called "elevating" portion) which has the placement portion and is capable of elevating in an up-down direction, an operation lever which is rotationally movable about a fulcrum, and a driving force transmission mechanism which converts rotational movement of the operation lever in an up-down direction to up-down movement of the elevating portion and transmits a driving force at a position of the operation lever, which is closer to the fulcrum.

An expression "roll paper" means a paper wound around a roll core in a roll form, in general. However, in the specification, the expression "roll paper" is defined as a paper including a roll core. Further, an expression "paper" includes a resin film such as polyester film in addition to a plain paper, an exclusive paper, and a gloss paper for a photograph. Further, the expression "paper" also includes a fabric beyond a range of the paper. With this, expressions are not complicated.

As for a thickness of the paper, papers having various thicknesses such as 0.3 mm and 1.3 mm, for example, are used. Further, an expression "roll core" includes a 2-inch paper core and a 3-inch paper core which are commonly used in a large-sized ink jet printer.

According to the aspect of the invention, an operation in which the roll paper is lifted to the height position of the shaft portion of the roll paper holder from the temporal placement portion, which has been performed manually by a user, can be executed by using a lifting device including the placement portion on which the roll paper is placed without a hard labor.

Further, the roll paper lifting device includes an elevating portion which has the placement portion and is capable of elevating in an up-down direction, an operation lever which is rotationally movable about a fulcrum, and a driving force transmission mechanism which converts the rotational movement of the operation lever in the up-down direction to the up-down movement of the elevating portion and transmits a driving force at a position of the operation lever, which is closer to the fulcrum.

That is to say, the operation in which a user lifts the roll paper to the height position of the shaft portion of the roll paper holder from the temporal placement portion is performed by using the operation lever which is rotationally movable about the fulcrum. Further, the rotational movement force of the operation lever is converted to up-down movement of the elevating portion and the driving force thereof is transmitted by the driving force transmission mechanism at the position of the operation lever, which is closer to the fulcrum. With this, the placement portion is moved up and down.

Accordingly, the roll paper can be lifted with a small force using the principle of leverage.

In this case, a portion at which the operation lever acts on the elevating portion corresponds to a point of load. A position at which a user grips the operation lever corresponds to a point of a lever. Therefore, as a rotation radius from the fulcrum to the point of a lever is larger than a rotation radius from the fulcrum to the point of load, a user can lift the roll paper with a smaller force.

In the recording apparatus according to a second aspect of the invention, it is preferable that the temporal placement portion include at least two rods which are arranged in parallel in a paper width direction, and a slide portion which is attached to the rods in a slidable manner and on which the end of the roll paper is capable of being temporarily placed, and a space having such size that a person is capable of putting his/her hand into the space be formed between the roll paper in a state of being temporarily placed on the slide portion and the rods, in the recording apparatus according to the first aspect of the invention.

According to the aspect of the invention, the slide portion on which the end of the roll paper can be temporarily placed is provided on the existing rods which have been used as temporal placement portions. Therefore, the slide portion can be used as a target position of the end of the roll paper when the roll paper is temporarily placed on the temporal placement portion first. This makes it possible to improve operability.

Further, the slide portion is slidingly moved appropriately in accordance with differences of a width of the roll paper so as to easily respond to the differences of the width.

Further, the space having such size that a person is capable of putting his/her hand into the space is formed between the roll paper in a state of being temporarily placed on the slide portion and the rods. Therefore, a space having the size that a person is capable of putting his/her hand into the space is formed between a lower face of the roll paper and the rods. Accordingly, an operation when the roll paper is temporarily placed on the temporal placement portion becomes easy to be performed.

In the recording apparatus according to a third aspect of the invention, it is preferable that the placement portion of the roll paper lifting device be configured such that a position of a placement face of the placement portion when the elevating portion is located at a lower limit position in a range where the elevating portion moves up and down is identical to a position of a temporal placement face of the slide portion, in the recording apparatus according to the second aspect of the invention.

An expression "identical" in the phrase "a position of a placement face of the placement portion is identical to a position of a temporal placement face of the slide portion" is used to indicate the following state in the specification and a scope of the invention. That is, the expression is used to indicate a state where when the end of the roll paper is temporarily placed on the temporal placement face of the slide portion, the end also makes contact with the placement portion and it can be said that the end of the roll paper are also placed on the placement portion. That is, the expression includes states from a state where the end of the roll paper is substantially supported by the slide portion and makes light contact with the placement portion to a state where the end of the roll paper is supported only by the placement portion.

According to the aspect of the invention, if the end of the roll paper is placed on the slide portion, the end of the roll paper is placed on the placement portion of the roll paper lifting device. Therefore, when the operation lever of the roll paper lifting device is rotationally moved, a user can rotationally move the operation lever while sensing a weight of the roll paper from the beginning of the rotational movement. Accordingly, the user is easy to sensuously grasp the degree of a force to be applied. This makes it possible to improve operability.

In the recording apparatus according to a fourth aspect of the invention, it is preferable that the temporal placement portion include at least two rods which are arranged in parallel in a paper width direction, the roll paper lifting device is configured such that a slide portion which is attached to the rods in a slidable manner is provided, a position of an upper face of the slide portion is located at a position lower than uppermost points of the rods, and the placement portion is moved to the upper side from the position lower than the uppermost points of the rods with respect to the slide portion and lifts the end of the roll paper which is temporarily placed on the rods, in the recording apparatus according to the first aspect of the invention.

According to the aspect of the invention, the slide portion does not project onto the rods. Therefore, when the roll paper is temporarily placed on the rods constituting the temporal placement portion, the slide portion does not hinder the temporal placement operation. In spite of this, since the position of the slide portion can be visually recognized, the slide portion can be used as a target position of the end of the roll paper when the roll paper is temporarily placed on the temporal placement portion as in the third aspect of the invention. This makes it possible to improve operability.

Further, a user can place the roll paper on the rods which are arranged in parallel as in the usual manner without any care of the hindrance due to the presence of the slide portion. Further, the user can lift the end of the roll paper to the height position of the shaft portion of the roll paper holder by appropriately adjusting an installing position of the slide portion and rotationally moving the operation lever subsequently.

In the recording apparatus according to a fifth aspect of the invention, it is preferable that the placement portion be configured so as to be swingable in accordance with an inclination posture of the roll paper, in the recording apparatus according to any one of the first to fourth aspects of the invention.

According to the aspect of the invention, with the swingable configuration, even if the roll paper in an inclination posture is placed on the placement portion and a circumferential body portion of the roll paper hits an edge of the placement portion, or the like, the roll paper is not damaged. Further, even if the roll paper is inclined, since the entire placement face of the placement portion uniformly makes contact with the circumferential body portion of the roll paper, a driving force is transmitted to the roll paper without loss.

In the recording apparatus according to a sixth aspect of the invention, it is preferable that the roll paper holder be attached to a supporting main body of the roll paper holder through an adjusting portion which enables an angle of the shaft portion variable in accordance with an inclination posture of the roll paper, in the recording apparatus according to any one of the first to fifth aspects of the invention.

According to the aspect of the invention, an axial line direction of the shaft portion of the roll paper holder can be made to be identical to a direction of a center line of the roll core of the roll paper lifted in the inclination posture due to the adjusting portion. Accordingly, positioning between the core port of the roll core and the shaft portion can be made easy so that the roll paper can be mounted on the roll paper holder easily.

In the recording apparatus according to a seventh aspect of the invention, it is preferable that the elevating portion include the placement portion, and a rod member which is provided so as to extend to the lower side from the placement portion, and the rod member be guided by a guiding portion provided on the slide portion so that the elevating portion is moved up and down in the vertical direction, in the recording apparatus according to any one of the first to sixth aspects of the invention.

According to the aspect of the invention, the placement portion moves up and down in the vertical direction together with the rod member. Therefore, the roll paper placed on the placement portion is lifted to the upper side in the vertical direction. Accordingly, if a center line of the roll core of the roll paper which is temporarily placed on the temporal placement portion and the axial line of the shaft portion of the roll paper holder are previously arranged so as to be located on the same plane in the vertical direction, the roll paper can be lifted to the height position of the shaft portion of the roll paper holder, and at the same time, positioning between the center line of the roll core and the shaft core of the shaft portion in the front-rear direction can be automatically executed.

The roll paper lifting device according to an eighth aspect of the invention, it is preferable that the roll paper lifting device be a device according to any one of the first, second, fourth, fifth and the seventh aspects.

It is to be noted that the roll paper lifting device is not limited to the lifting device for the recording apparatus.

According to the aspect of the invention, in the roll paper lifting device, the effecs as described in each of the above aspects can be obtained.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 7:
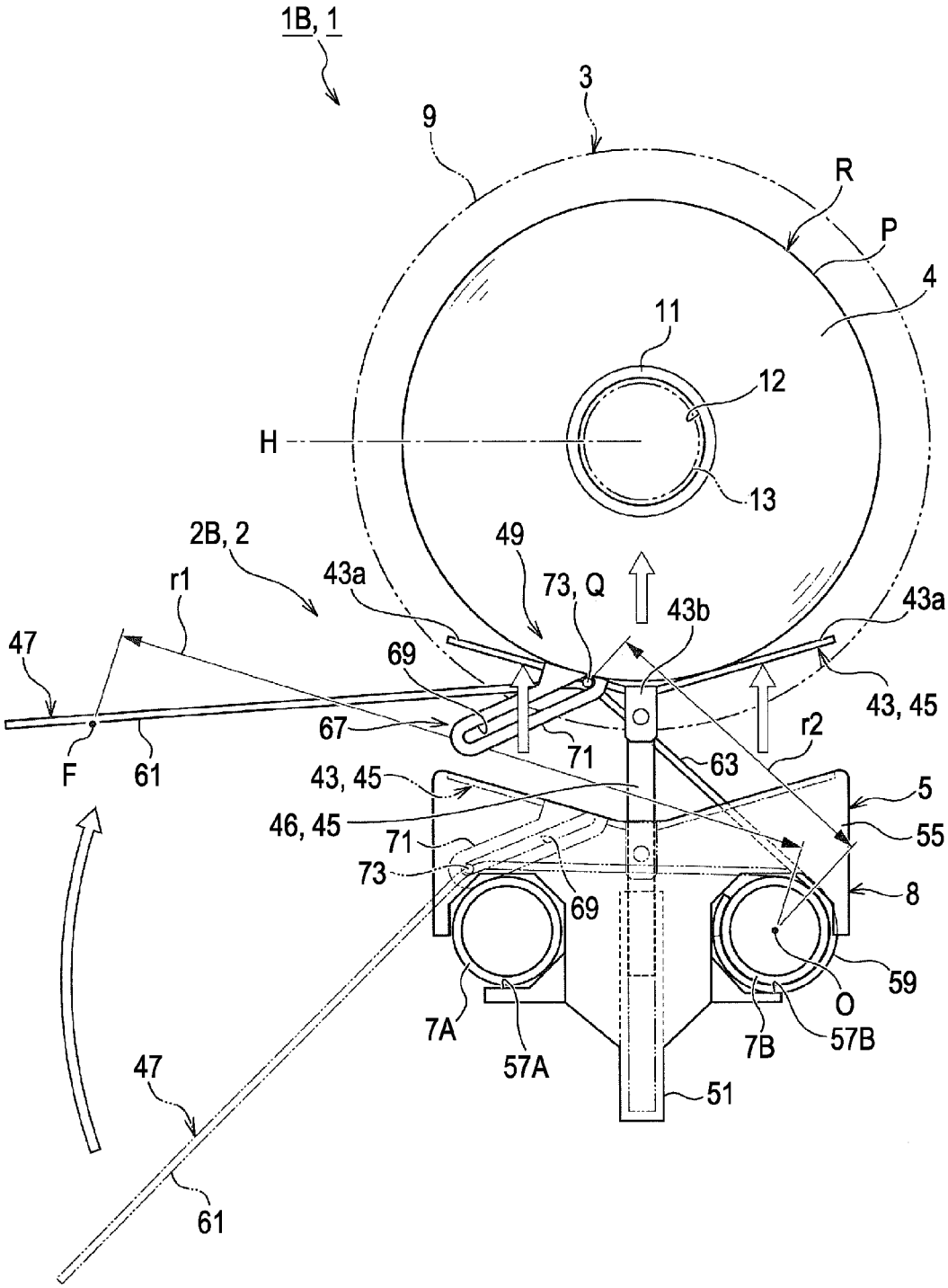
FIG. 7 is a side view illustrating a lifting device according to a second embodiment of the invention.
Figure 8:
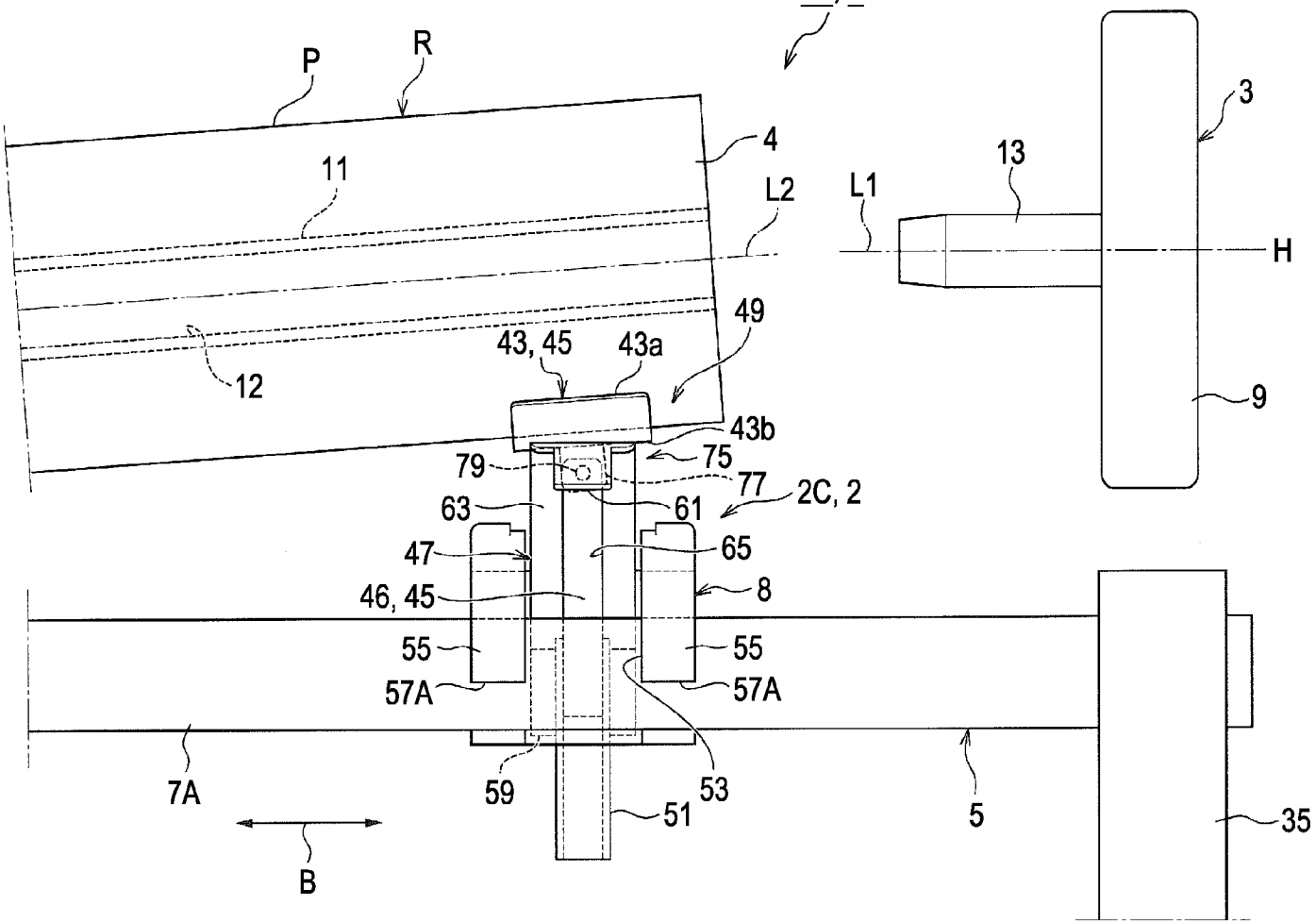
FIG. 8 is a front view illustrating a lifting device according to a third embodiment of the invention.
Figure 9:
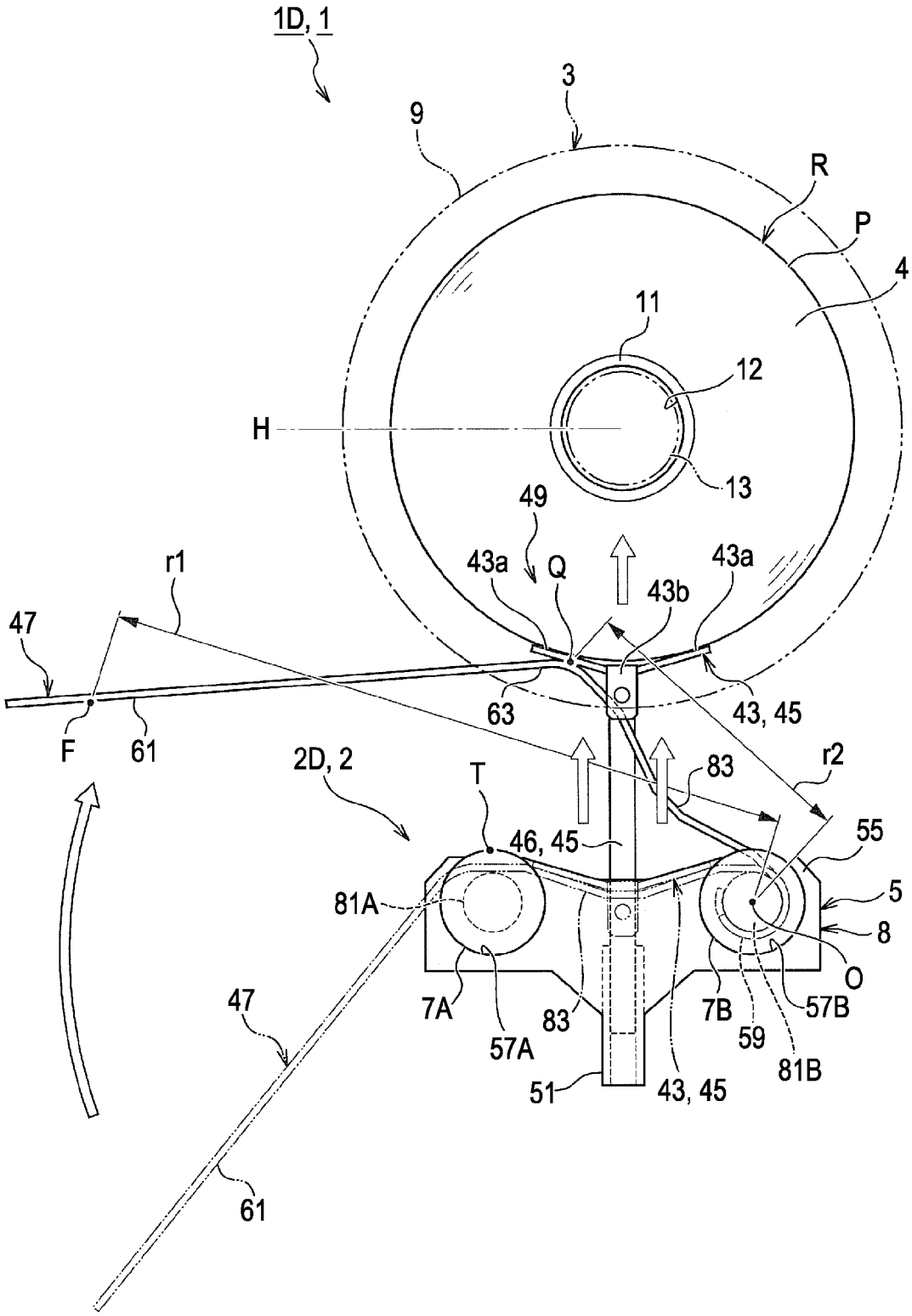
FIG. 9 is a side view illustrating a lifting device according to a fourth embodiment of the invention.
Figure 10:
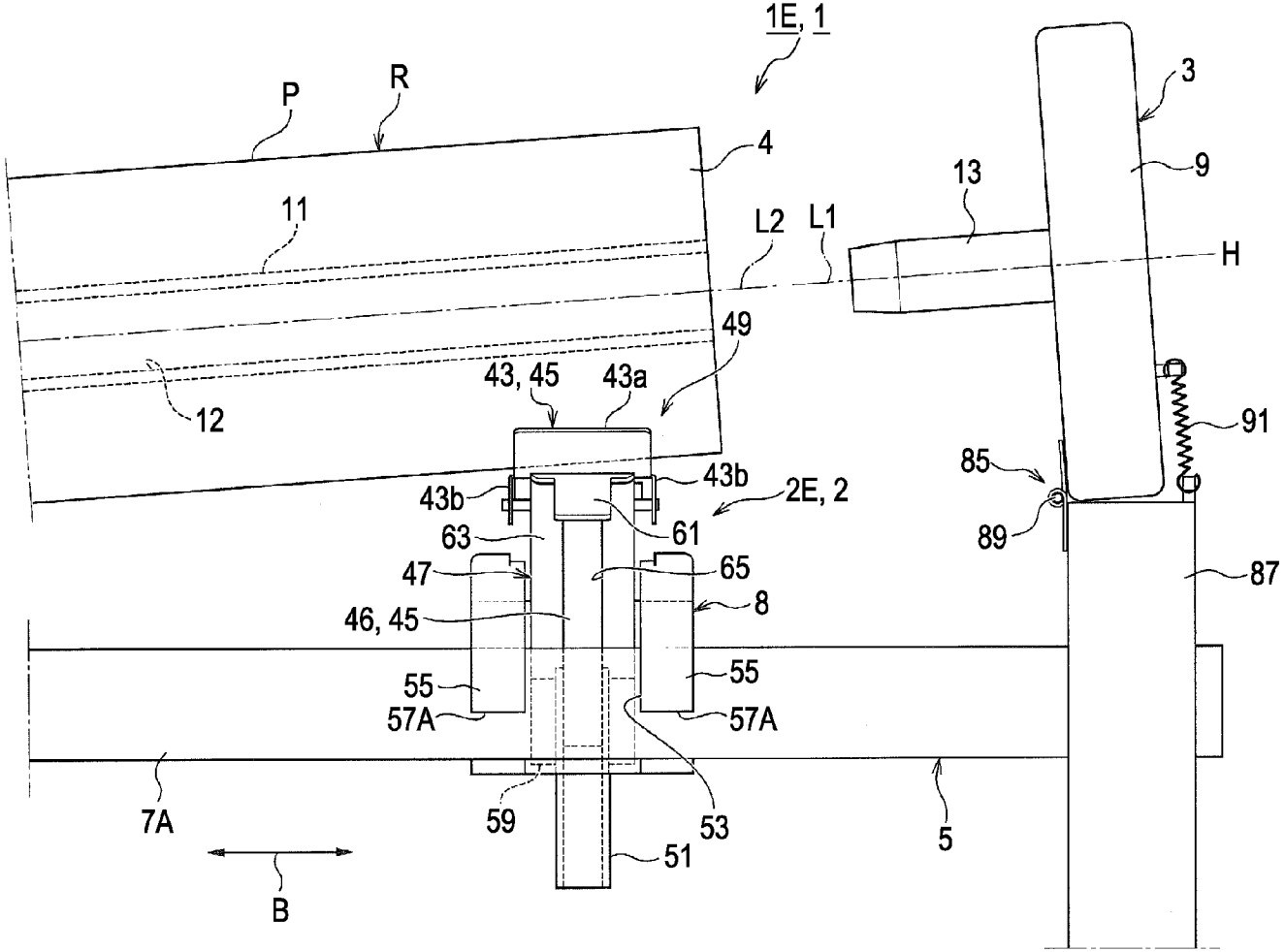
FIG. 10 is a front view illustrating an adjusting portion of a roll paper holder according to a fifth embodiment of the invention when a roll paper is positioned.

Hereinafter, configurations and operation modes of a recording apparatus 1 according to the invention are described in detail by taking a first embodiment as illustrated in FIG. 1 to FIG. 6, a second embodiment as illustrated in FIG. 7, a third embodiment as illustrated in FIG. 8, a fourth embodiment as illustrated in FIG. 9, and a fifth embodiment as illustrated in FIG. 10 as examples. At first, a schematic entire configuration of the recording apparatus 1 according to the invention is described with reference to FIG. 1.

Figure 1:
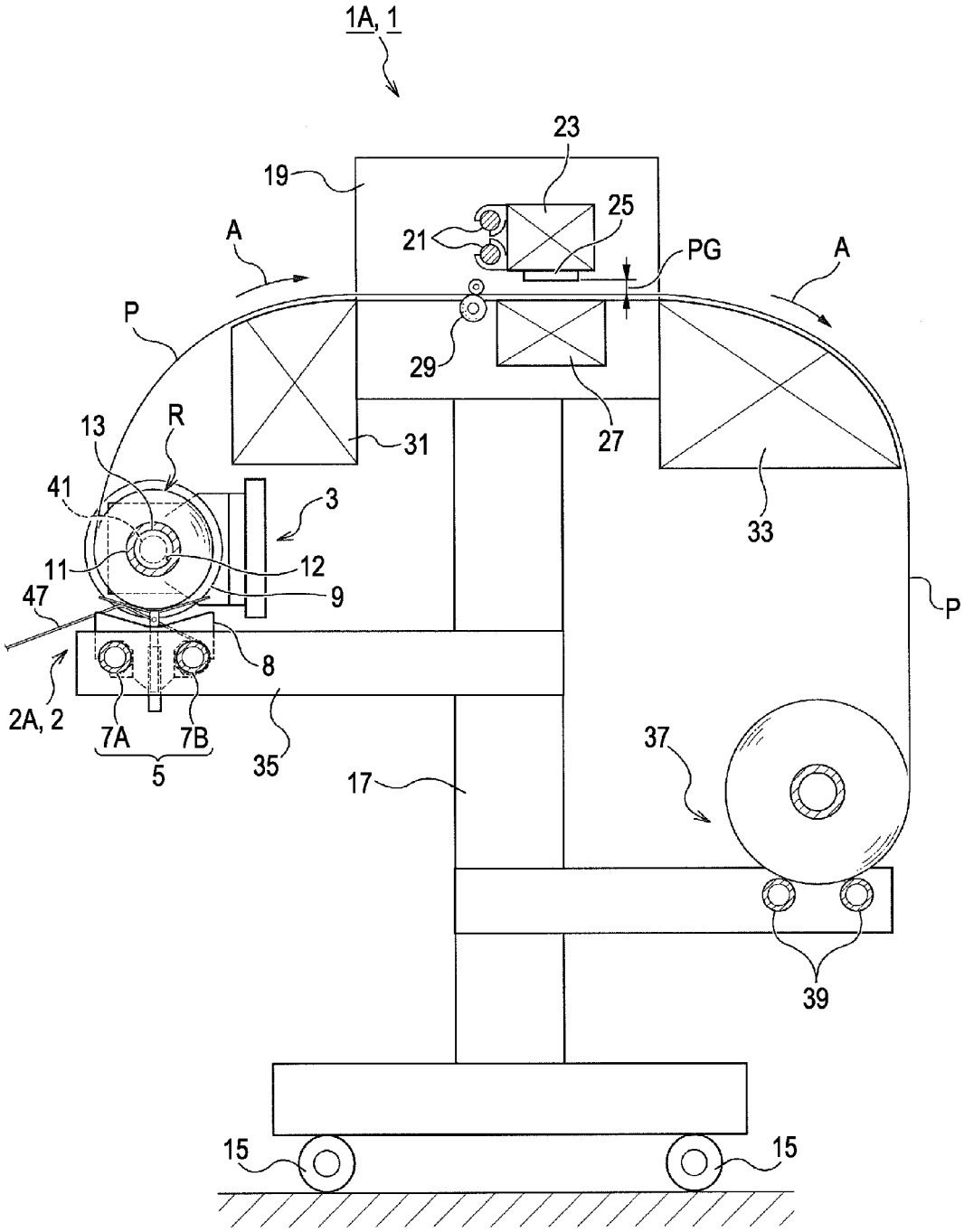
FIG. 1 is a side cross-sectional view illustrating a schematic entire configuration of a recording apparatus according to the invention.

FIG. 1 illustrates the schematic entire configuration of a large-sized ink jet printer 1 as the recording apparatus according to an embodiment of the invention. The ink jet printer 1 includes supporting frames 17 having inverted T shapes when seen from the side at both right and left ends thereof so as to be opposed to each other. The supporting frames 17 have casters 15 for movement at lower ends thereof.

A printer main body 19 is provided on an upper side of the supporting frames 17. A carriage 23 is arranged in the printer main body 19. The carriage 23 can reciprocate in a paper width direction B as a main scanning direction along carriage guide shafts 21.

Further, a recording head 25 is provided on a lower face of the carriage 23 as an example. The recording head 25 discharges inks of each color on a recorded face of a paper P so as to execute recording. A supporting member 27 is provided at a lower side of the recording head 25. The supporting member 27 supports a lower face of the paper P with a predetermined gap PG therebetween and guides transportation of the paper P.

Further, a transportation roller 29 is provided at an upstream-side position with respect to the recording head 25 and the supporting member 27 in a paper transportation direction A. The transportation roller 29 is constituted by a pair of nip rollers. Further, the paper P fed from roll paper holders 3, which will be described later, is nipped and held by the transportation roller 29 so that a transportation force is applied to the paper P.

Further, a pre-heater 31 for preliminary heating is provided at a rear-side position as an upstream-side position of the printer main body 19 in the paper transportation direction A. An after-heater 33 for drying ink is provided at a front-side position as a downstream-side position of the printer main body 19 in the paper transportation direction A.

Roll paper holders 3 are provided at upstream-side positions of the pre-heater 31 in the paper transportation direction A. Each roll paper holder 3 includes a shaft portion 13 which holds a roll paper R such that the roll paper is capable of being fed. A temporal placement table 5 for the roll paper R is provided at a lower side of the roll paper holders 3. The temporal placement table 5 is supported by a sub frame 35 extending from the supporting frames 17.

The roll paper holders 3 are members which hold both ends of the roll paper R. A pair of roll paper holders 3 are arranged so as to be opposed to each other. Further, at least one of these roll paper holders 3 is configured to slide in the paper width direction B in accordance with differences of a width of the roll paper R so as to adjust an attachment position thereof.

To be more specific, each roll paper holder 3 includes a flange portion 9 having a circular plate shape and the shaft portion 13 having a round rod shape as an example. The flange portion 9 makes contact with a side end face 4 of the roll paper R to hold the roll paper R. The shaft portion 13 is horizontally arranged so as to project to the inner side from the flange portion 9 and is inserted into a core port 12 of a roll core 11 of the roll paper R so as to hold the roll paper R.

On the other hand, the temporal placement table 5 is a member used for temporarily placing the roll paper P before the roll paper R is mounted on the roll paper holders 3.

Figure 2:
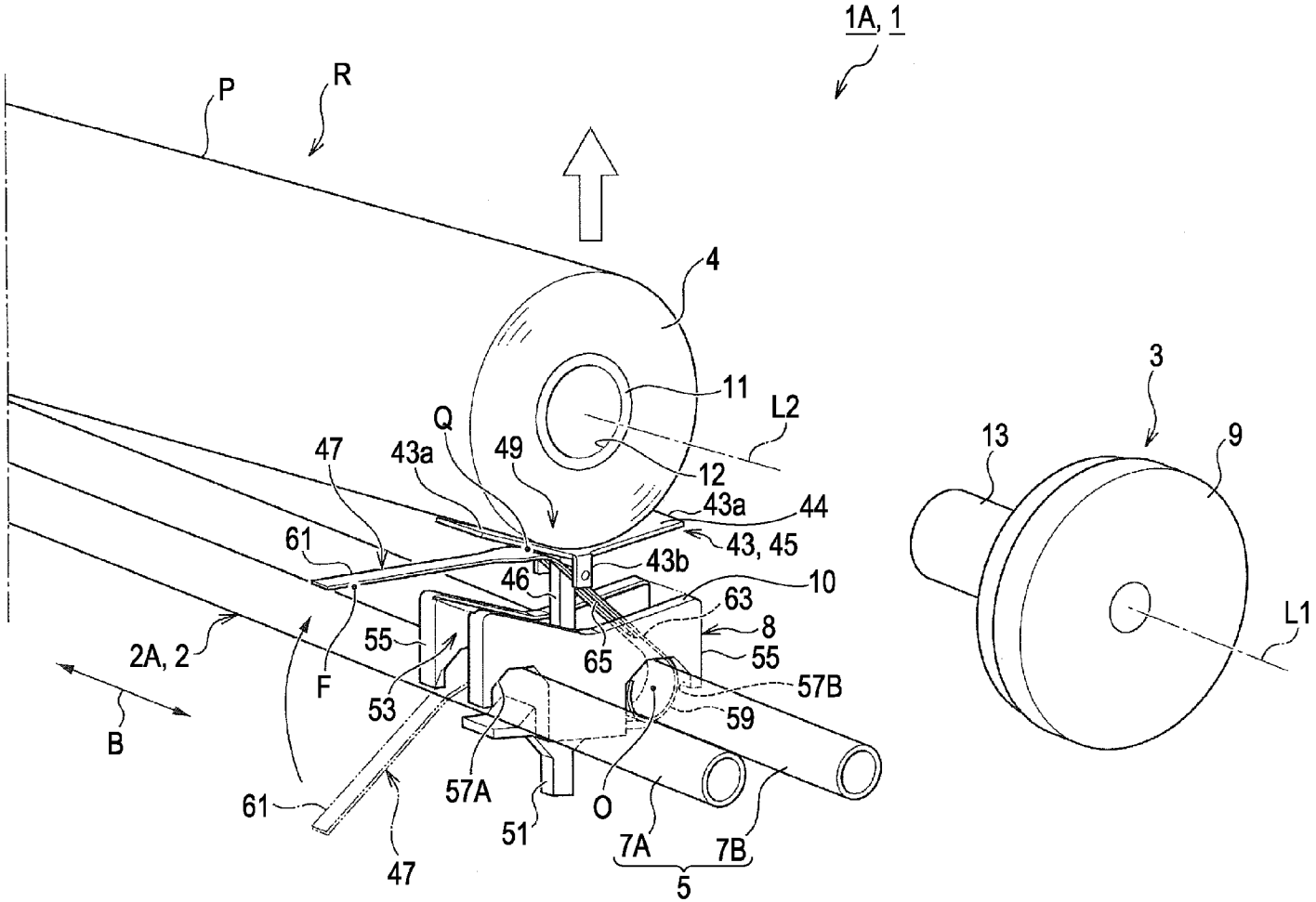
FIG. 2 is a perspective view around the periphery of a lifting device according to a first embodiment of the invention.

To be more specific, the temporal placement table 5 includes at least two rods 7A, 7B which are arranged in parallel in the paper width direction B as illustrated in FIG. 1 and FIG. 2. The rods 7A, 7B are arranged in parallel so as to provide a gap therebetween. The gap provided between the rods 7A, 7B has such size that the roll paper R does not drop through the space when the roll paper R is temporarily placed. It is sufficient that the roll paper R can be temporarily placed on the temporal placement table 5. Therefore, it is needless to say that a configuration of the temporal placement table 5 is not limited to the configuration in which the temporal placement table 5 includes the two rods 7A, 7B.

Slide portions 8 which also serve as supporting members for a roll paper lifting device 2, which will be described later, are attached to the rods 7A, 7B in a slidable manner. In the embodiment, each of the rods 7A, 7B is formed with a round rod of which cross section is a circular shape. It is to be noted that a pair of slide portions 8 are provided so as to correspond to the pair of roll paper holders 3, respectively.

Further, the roll paper lifting device 2 is provided on the ink jet printer 1. The lifting device 2 is a member which lifts end faces of the roll paper R placed on the temporal placement table 5 to a height position H of the shaft portions 13 of the roll paper holders 3 so as to position the core port 12 of the roll core 11 of the roll paper R and the shaft portions 13. The lifting device 2 includes a placement portion 43 on which the roll paper R is placed on an upper portion thereof.

In addition, a winding device 37 which winds up the paper P on which recording has been executed is provided at a downstream-side position of the after-heater 33 in the paper transportation direction A. The wound roll paper R is supported by paper supporting mechanisms 39.

First Embodiment (See, FIG. 1 to FIG. 6)

An ink jet printer 1A according to the first embodiment is configured as follows.

The temporal placement table 5 of the ink jet printer 1A includes the two rods 7A, 7B and the slide portion 8.

Figure 4:
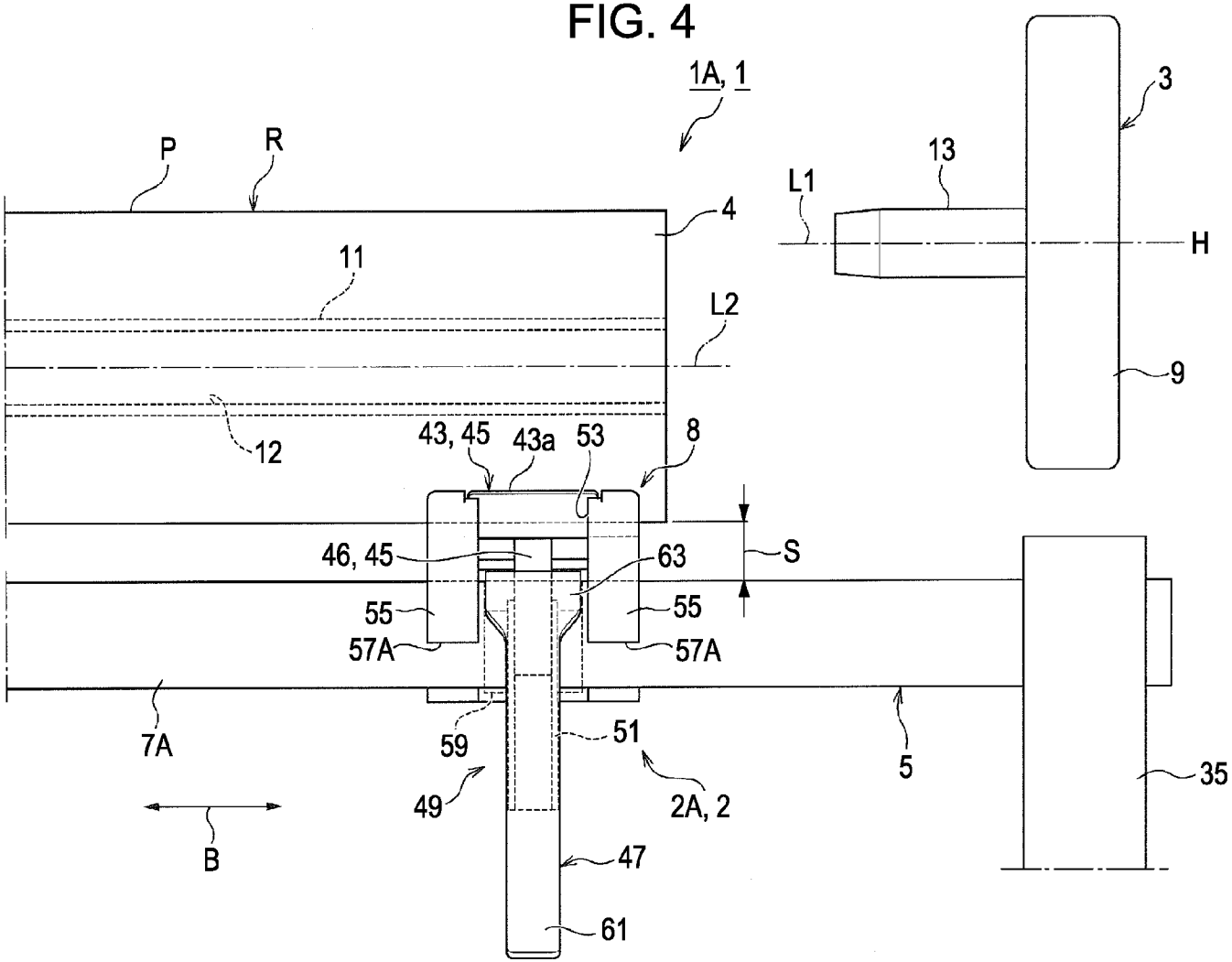
FIG. 4 is a front view illustrating the lifting device at a lower limit position according to the first embodiment of the invention.
Figure 5:
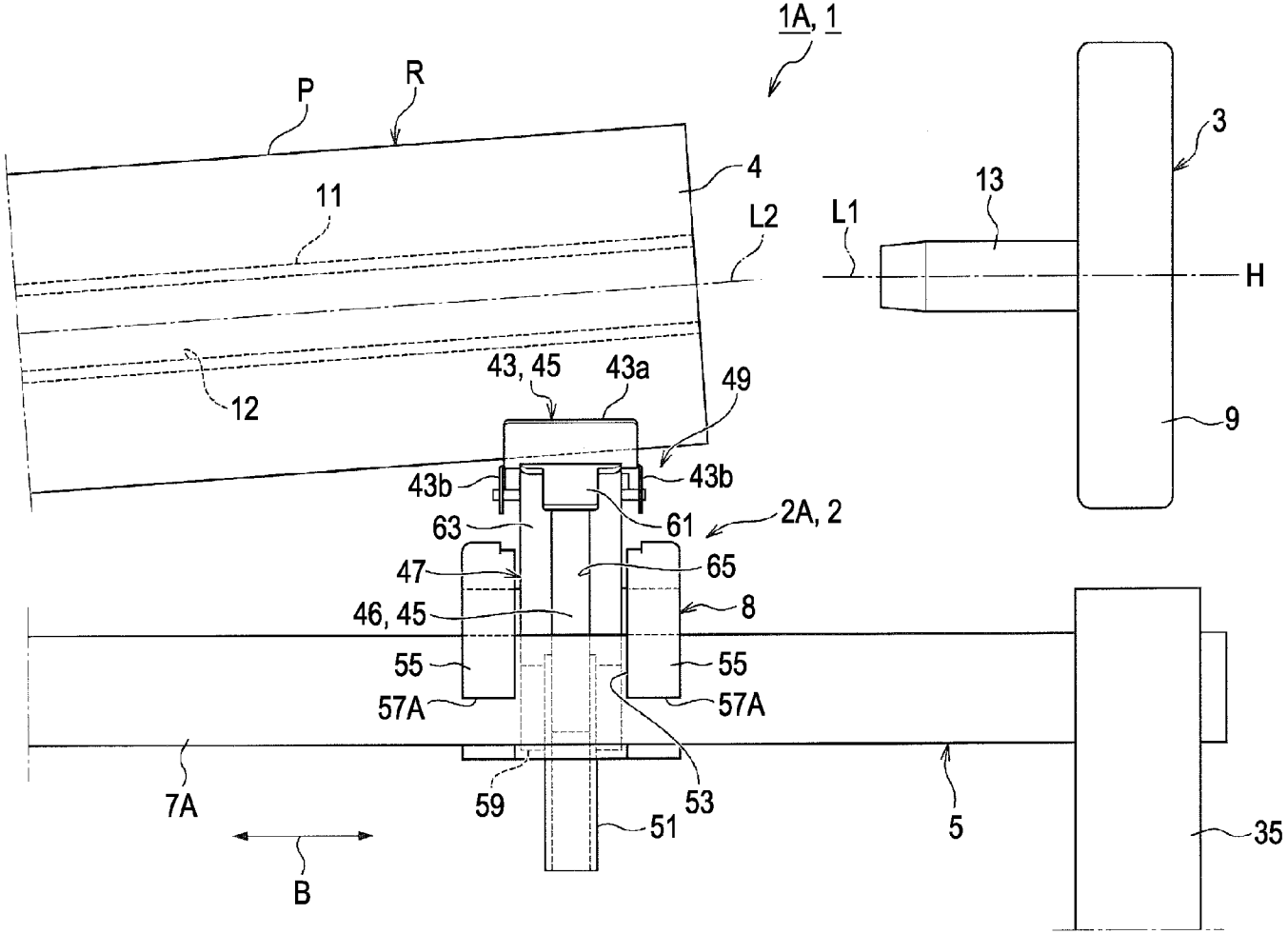
FIG. 5 is a front view illustrating the lifting device at an upper limit position according to the first embodiment of the invention.
Figure 6:
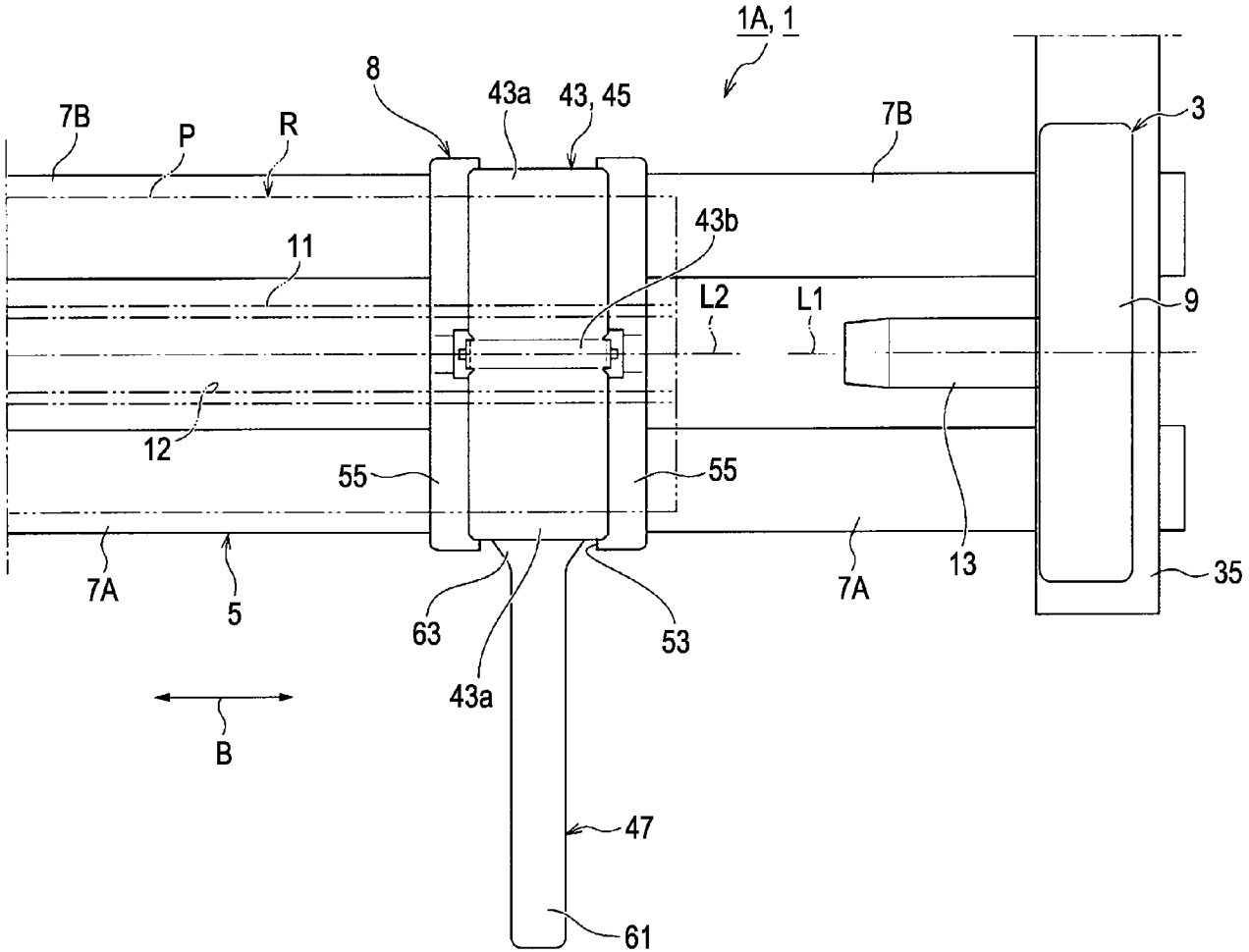
FIG. 6 is a plan view illustrating the lifting device at the lower limit position according to the first embodiment of the invention.

The slide portion 8 is formed such that an upper face thereof is formed into a shallow concave shape as an example. To be more specific, the slide portion 8 is formed such that a center thereof is made lower and corner portions on both ends at front and rear sides are made higher in the shape of the upper face. The upper face of the slide portion 8 corresponds to a temporal placement face 10 on which an end of the roll paper R can be temporarily placed. Further, as illustrated in FIG. 4, a space S having such size that a person is capable of putting his/her hand into the space S is formed between the lower face of the roll paper R in a state of being temporarily placed on the slide portion 8 and upper faces of the rods 7A, 7B.

That is to say, the slide portion 8 is configured such that a position of the temporal placement face 10 of the slide portion 8 is located at the upper side of the rods 7A, 7B. At this time, the space S is formed between the slide portion 8 and the rods 7A, 7B.

If such space S is formed, a space having such size that a person is capable of putting his/her hand into the space is formed between the roll paper R and the rods 7A, 7B. Therefore, an operation when the roll paper R is temporarily placed on the temporal placement table 5 becomes easy to be performed.

Further, the slide portion 8 on which the end of the roll paper R can be temporarily placed is provided on the existing rods 7A, 7B which have been used as temporal placement portions. Therefore, the slide portion 8 can be used as a target position of the end of the roll paper R when the roll paper R is temporarily placed on the temporal placement table 5. This makes it possible to improve operability.

Figure 3:
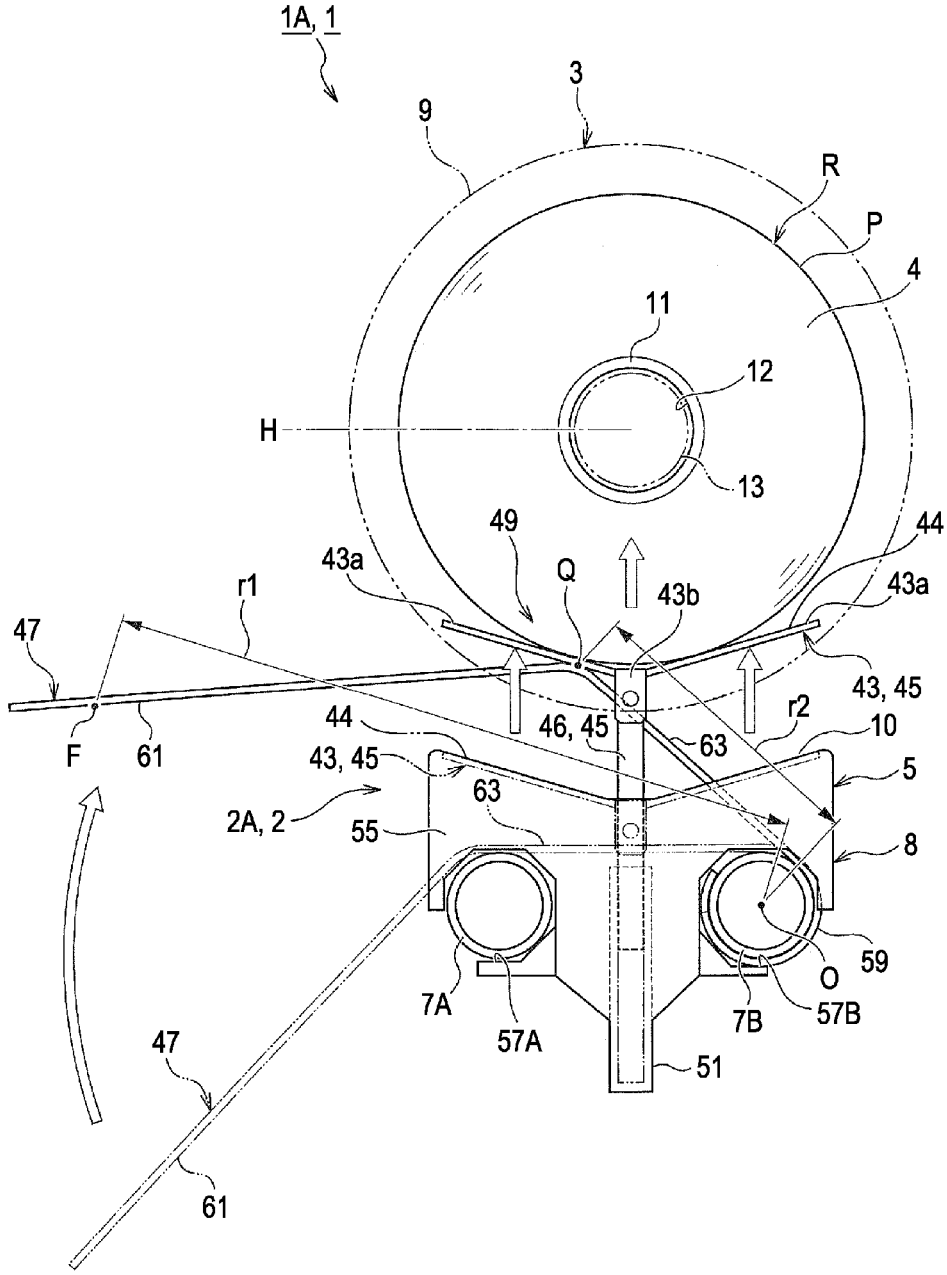
FIG. 3 is a side view illustrating the lifting device according to the first embodiment of the invention.

In the embodiment, the slide portion 8 includes two side plate portions 55, 55 which are arranged such that a gap 53 is formed therebetween as illustrated in FIG. 2 and FIG. 3. The gap 53 serves as a region which accommodates an elevating portion 45, which will be described later, when the elevating portion 45 is located at a lower limit position in a range where the elevating portion 45 moves up and down. Further, the gap 53 corresponds to a region in which an operation lever 47, which will be described later, can be rotationally moved in the up-down direction. In addition, the slide portion 8 includes fitting holes 57A, 57B and a guiding portion 51. The rods 7A, 7B which are provided so as to penetrate through the two side plate portions 55, 55 are fitted into the fitting holes 57A, 57B. The guiding portion 51 is provided at a midpoint of the two side plate portions 55, 55 so as to be sandwiched therebetween.

Then, a roll paper lifting device 2A of the ink jet printer 1A according to the first embodiment includes the elevating portion 45, the operation lever 47, and a driving force transmission mechanism 49. The elevating portion 45 has the placement portion 43 on which the roll paper R is placed and can elevate in the up-down direction. The operation lever 47 is attached to the rod 7B in a slidable manner so as to be integral with the slide portion 8 which also serves as a supporting member of the elevating portion 45. Further, the operation lever 47 is rotationally movable about a center position of the rod 7B as a fulcrum O. The driving force transmission mechanism 49 makes the operation lever 47 abut against a lower face of the placement portion 43 at a position closer to the fulcrum O of the operation lever 47. Further, the driving force transmission mechanism 49 converts the rotational movement of the operation lever 47 in the up-down direction to up-down movement of the elevating portion 45 and transmits a driving force thereof at the position.

In the embodiment, the placement portion 43 is formed into a shape which is substantially the same as that of the temporal placement face 10 of the slide portion 8, as illustrated in FIG. 2 and FIG. 3. That is to say, the placement portion 43 includes two wing plate portions 43*a*, 43*a* and a coupling portion 43*b*. The wing plate portions 43*a*, 43*a* are arranged so as to be symmetry to each other in inclination postures in which a center thereof is made lower and each front end is made higher at some degree. The coupling portion 43*b* couples the two wing plate portions 43*a*, 43*a* at a center portion thereof.

As illustrated in FIG. 3, the elevating portion 45 includes the placement portion 43 and a rod member 46 which extends to the lower side from the placement portion 43. In the embodiment, the rod member 46 is formed by a square bar, as an example, which is coupled to the coupling portion 43*b* of the placement portion 43 and extends to the lower side in the vertical direction.

Further, the rod member 46 is guided by the guiding portion 51 provided on the slide portion 8 so that the elevating portion 45 moves up and down in the vertical direction. In the embodiment, the rod member 46 is fitted into the guiding portion 51 having a square cylindrical shape as an example, which is formed on the slide portion 8. Therefore, the up-down movement of the rod member 46 in the vertical direction is guided by the guiding portion 51.

As illustrated in FIG. 2 and FIG. 3, a fulcrum-curling portion 59 is provided on the operation lever 47 at a base end of a lever main body 63 which is a long plate member. The fulcrum-curling portion 59 is formed in a curling form so as to wrap around the rod 7B. A portion of the operation lever 47 at the side of a free end serves as an operation portion 61 which a user grips by his/her hand and operates. The operation portion 61 is formed to be narrower in width at some degrees in comparison with other portions such that the user is easy to operate.

A cutout portion 65 which extends in the lengthwise direction of the lever main body 63 is formed at a center of the lever main body 63 in the width direction. The rod member 46 of the elevating portion 45 is fitted into the cutout portion 65 so that the elevating portion 45 and the operation lever 47 are prevented from being interfered with each other.

Further, the lever main body 63 is bent at a portion closer to the free end of the operation portion 61 such that the free end is made lower at an initial position. The portion at which the lever main body 63 is bent serves as a point of load Q at which the lever main body 63 abuts against the lower face of the placement portion 43.

Further, the fulcrum-curling portion 59 which is formed in a curling form so as to wrap around the rod 7B is provided on the base end of the lever main body 63. An axial line of the rod 7B as a center of the fulcrum-curling portion 59 corresponds to the fulcrum O as a center of the rotational movement of the operation lever 47.

That is to say, the driving force transmission mechanism 49 is constituted by the operation lever 47 which rotationally moves about the fulcrum O in the up-down direction and the lower face of the placement portion 43. The driving force transmission mechanism 49 converts the rotational movement of the operation lever 47 in the up-down direction to the up-down movement of the elevating portion 45 and transmits a driving force thereof by rotationally moving the operation lever 47, making the point of load Q abut against the lower face of the placement portion 43 and further continuing the rotational movement of the operation lever 47.

Further, the placement portion 43 is configured such that a position of the placement face 44 of the placement portion 43 when the elevating portion 45 is located at the lower limit position (two-dot chain line in FIG. 3) in a range where the elevating portion 45 moves up and down is the same to a position of the temporal placement face 10 of the slide portion 8.

With the same configuration, if the end of the roll paper R is placed on the slide portion 8 in a temporal placement process, the roll paper R is placed on the placement portion 43 of the roll paper lifting device 2A. Therefore, when the operation lever of the roll paper lifting device 2A is rotationally moved, a user can rotationally move the operation lever while sensing a weight of the roll paper from the beginning of the rotational movement. Accordingly, the user is easy to sensuously grasp the degree of a force to be applied. This makes it possible to improve operability.

Next, an operation mode when the end of the roll paper R is lifted to the height position H of the shaft portion 13 of the roll paper holder 3 using the ink jet printer 1A having such configuration according to the first embodiment is described.

That is to say, in the embodiment, the roll paper lifting device 2A can lift the roll paper R with a small force using the principle of leverage.

To be more specific, the portion at which the lever main body 63 is bent and the operation lever 47 abuts against the elevating portion 45 corresponds to the point of load Q, as described above. A position at which the user grips the operation portion 61 of the operation lever 47 corresponds to a point of a lever F. Further, the shaft core of the rod 7B at a center of the fulcrum-curling portion 59 which is connected to the rod 7B in a rotationally movable manner corresponds to the fulcrum O.

In the embodiment, a rotation radius r1 from the fulcrum O to the point of a lever F is larger than a rotation radius r2 from the fulcrum O to the point of load Q. Therefore, a user can lift the roll paper R with a smaller force.

Further, the operation lever 47 transmits a driving force to the roll paper R through the placement portion 43 of the elevating portion 45 without making contact with the roll paper R. Therefore, the roll paper R is not damaged when the roll paper R is lifted.

Further, the elevating portion 45 is guided by the guiding portion 51 so as to move up and down in the vertical direction. Therefore, if a center line L2 of the roll core 11 of the roll paper R placed on the temporal placement table 5 and a shaft core L1 of the shaft portion 13 of the roll paper holder 3 are previously arranged so as to be located on the same plane in the vertical direction, the roll paper R can be lifted to the height position H of the shaft portion 13 of the roll paper holder 3, and at the same time, positioning between the center line L2 of the roll core 11 and the shaft core L1 of the shaft portion 13 in the front-rear direction can be also automatically executed.

Then, after the positioning between the roll paper R and the roll paper holder 3 in the vertical direction and in the front-rear direction is completed, the shaft portion 13 of the roll paper holder 3 is inserted into the core port 12 of the roll core 11 of the roll paper R and the side end face 4 of the roll paper R is made to abut against an inner side face of the flange portion 9 of the roll paper holder 3. With this, the roll paper R is completely mounted on the roll paper holder 3 at one side.

If the other end of the roll paper R is mounted on the other roll paper holder 3 in the same manner, both ends of the roll paper R are finished to be set to the roll paper holders 3, and the roll paper R is held in a horizontal posture in which recording can be executed on the roll paper R.

Second Embodiment (See, FIG. 7)

An ink jet printer 1B according to the second embodiment has the same configuration as that of the ink jet printer 1A according to the first embodiment excluding the following point. That is, a coupling mechanism 67 which couples the operation lever 47 and the elevating portion 45 is applied to the driving force transmission portion of the operation lever 47 in the ink jet printer 1B according to the second embodiment. Accordingly, description is given while focusing on a configuration of the coupling mechanism 67 which is different from the first embodiment and is characteristic to the second embodiment.

As illustrated in FIG. 7, in the embodiment, a coupling plate 71 on which a long and narrow hole 69 is formed is provided on one of the two wing plate portions 43*a* of the placement portion 43. Further, a coupling shaft 73 which engages with the long and narrow hole 69 is provided on the portion at which the lever main body 63 of the operation lever 47 is bent. The ink jet printer 1B includes a lifting device 2B in which the coupling mechanism 67 including the coupling plate 71 and the coupling shaft 73 is applied to the driving force transmission portion of the operation lever 47.

With the ink jet printer 1B having such configuration according to the second embodiment, the same effects as those obtained in the first embodiment can be obtained and troublesome operation of a user when lifting the roll paper R can be reduced.

Further, in the embodiment, the operation lever 47 and the elevating portion 45 are coupled to each other. Therefore, the operation lever 47 and the elevating portion 45 are prevented from being separated from each other due to its structure. Accordingly, breakage of parts due to unexpected separation between the operation lever 47 and the elevating portion 45, which is caused by abrupt rotational movement of the operation lever 47, or the like, and dropping of the roll paper R from the placement portion 43 can be prevented.

Third Embodiment (See, FIG. 8)

An ink jet printer 1C according to the third embodiment has the same configuration as that of the ink jet printer 1A according to the first embodiment excluding the following point. That is, a swing mechanism 75 is applied between the placement portion 43 and the rod member 46 in the ink jet printer 1C according to the third embodiment. Accordingly, description is given while focusing on a configuration of the swing mechanism 75 which is different from the first embodiment and is characteristic to the third embodiment.

As illustrated in FIG. 8, in the embodiment, the swing mechanism 75 is constituted by forming two swing-tongue pieces 77, 77 (only one swing-tongue piece 77 is illustrated in FIG. 8) at the lower side of the coupling portion 43*b* of the placement portion 43 and providing a swing shaft 79. The swing-tongue pieces 77, 77 project so as to sandwich a front face and a rear face of the rod member 46 at an upper end thereof. The swing shaft 79 is provided so as to penetrate through the two swing-tongue pieces 77, 77, which are opposed to each other, and the front face and the rear face of the rod member 46 at an upper end thereof.

With the ink jet printer 1C including a lifting device 2C in which such swing mechanism 75 is applied according to the third embodiment, the same effects as those obtained in the first embodiment can be also obtained and troublesome operation of a user when lifting the roll paper R can be reduced.

Further, in the embodiment, the placement portion 43 can be swung in the right-left direction about the swing shaft 79 in accordance with an inclination posture of the roll paper R. Therefore, a circumferential body portion of the roll paper R is not damaged by edges of the placement portion 43, or the like. Further, the placement portion 43 is made to act so as to entirely make contact with the circumferential body portion of the roll paper R so that a driving force is transmitted to the roll paper R without loss.

Fourth Embodiment (See, FIG. 9)

An ink jet printer 1D according to the fourth embodiment is configured such that a position of the upper face of the slide portion 8 is located at a position lower than uppermost points T of the rods 7A, 7B. Further, a length of the placement portion 43 in the front-rear direction is formed to be shorter so as to pass through the space between the rods 7A, 7B which are arranged in parallel. The ink jet printer 1D according to the fourth embodiment has the same configuration as that of the ink jet printer 1A according to the first embodiment excluding these points. Accordingly, description is given while focusing on the configurations which are different from the first embodiment and are characteristic to the fourth embodiment.

As illustrated in FIG. 9, in the embodiment, the position of the upper face of the slide portion 8 is located at the position lower than the uppermost points T of the rods 7A, 7B. The fulcrum-curling portion 59 which is provided at the base end of the operation lever 47 is attached to a small diameter portion 81 provided on a part of the rods 7A, 7B. Further, a part of the lever main body 63 of the operation lever 47 is bent into a concave shape. The bent portion serves as an evacuation portion 83 which prevents the lever main body 63 from being interfered with the placement portion 43 located at the lower limit position.

Further, the placement portion 43 of which length in the front-rear direction is set to be shorter so as to pass through the space between the rods 7A, 7B is formed on the upper face of the slide portion 8. The placement portion 43 is configured such that the placement portion 43 at the lower limit position is at the substantially the same height as the slide portion 8 as in the first embodiment.

On the other hand, when the roll paper R is moved to the upper limit position of the height position H of the shaft portion 13 of the roll paper holder 3, the placement portion 43 is moved to the upper side from the position lower than the uppermost points T of the rods 7A, 7B to the upper limit position through the space between the rods 7A, 7B.

With the ink jet printer 1D including a lifting device 2D having such configuration according to the fourth embodiment, the same effects as those obtained in the first embodiment can be also obtained and troublesome operation of a user when lifting the roll paper R can be reduced.

Further, the slide portion 8 does not project onto the rods 7A, 7B. Therefore, when the roll paper R is temporarily placed on the rods 7A, 7B constituting the temporal placement table 5, the slide portion 8 does not hinder the temporal placement operation. In spite of this, since the position of the slide portion 8 can be visually recognized, the slide portion 8 can be used as a target position of the end of the roll paper R when the roll paper R is temporarily placed on the temporal placement table 5 as in the third embodiment. This makes it possible to improve operability.

Further, in the embodiment, a user can place the roll paper R on the rods 7A, 7B which are arranged in parallel without caring the installing position of the slide portion 8 as in the usual manner. Further, the user can lift the roll paper R to the height position H of the shaft portion 13 of the roll paper holder 3 by adjusting the installing position of the slide portion 8 and operating the operation lever 47 subsequently.

Fifth Embodiment (See, FIG. 10)

An ink jet printer 1E according to the fifth embodiment has the same configuration as that of the ink jet printer 1A according to the first embodiment excluding the following point. That is, an adjusting portion 85 which enables the roll paper holder 3 to oscillate is applied thereto in the ink jet printer 1E according to the fifth embodiment. Accordingly, description is given while focusing on a configuration of the adjusting portion 85 which is different from the first embodiment and is characteristic to the fifth embodiment.

As illustrated in FIG. 10, in the embodiment, the adjusting portion 85 is provided between the roll paper holder 3 and the supporting main body 87 for the roll paper holder 3. The adjusting portion 85 can adjust an angle of the shaft portion 13 in accordance with an inclination posture of the roll paper R.

The adjusting portion 85 is basically configured by including a hinge portion 89 and a biasing member 91. The hinge portion 89 couples the roll paper holder 3 and the supporting main body 87 in a rotationally movable manner in predetermined angles. The biasing member 91 biases such that the shaft core L1 of the shaft portion 13 of the roll paper holder 3 is located horizontally all the time.

With the ink jet printer 1E including the adjusting portion 85 having such configuration according to the fifth embodiment, the same effects as those obtained in the first embodiment can be obtained and troublesome operation of a user when lifting the roll paper R can be reduced.

Further, in the embodiment, the direction of the shaft core L1 of the shaft portion 13 of the roll paper holder 3 can be made to be identical to the direction of the center line L2 of the roll core 11 of the roll paper R lifted in the inclination posture. With this, positioning between the core port 12 of the roll core 11 and the shaft portion 13 can be made easy so that the roll paper R can be mounted on the roll paper holder 3 easily.

Other Embodiments

The recording apparatus 1 according to the invention has the basic configuration as described above. However, it is needless to say that change and omission of partial configurations can be made in a range without departing from the scope of the invention.

All the driving of the roll paper lifting device 2 is performed by the operation lever 47 manually as described in each of the above embodiments. However, for example, a roll paper lifting device 2 having a configuration in which a range of the driving, such as starting of the operation with a large load, is automated to assist the rotational movement of the operation lever 47, or the driving is entirely automated can be applied.

Figure 11:
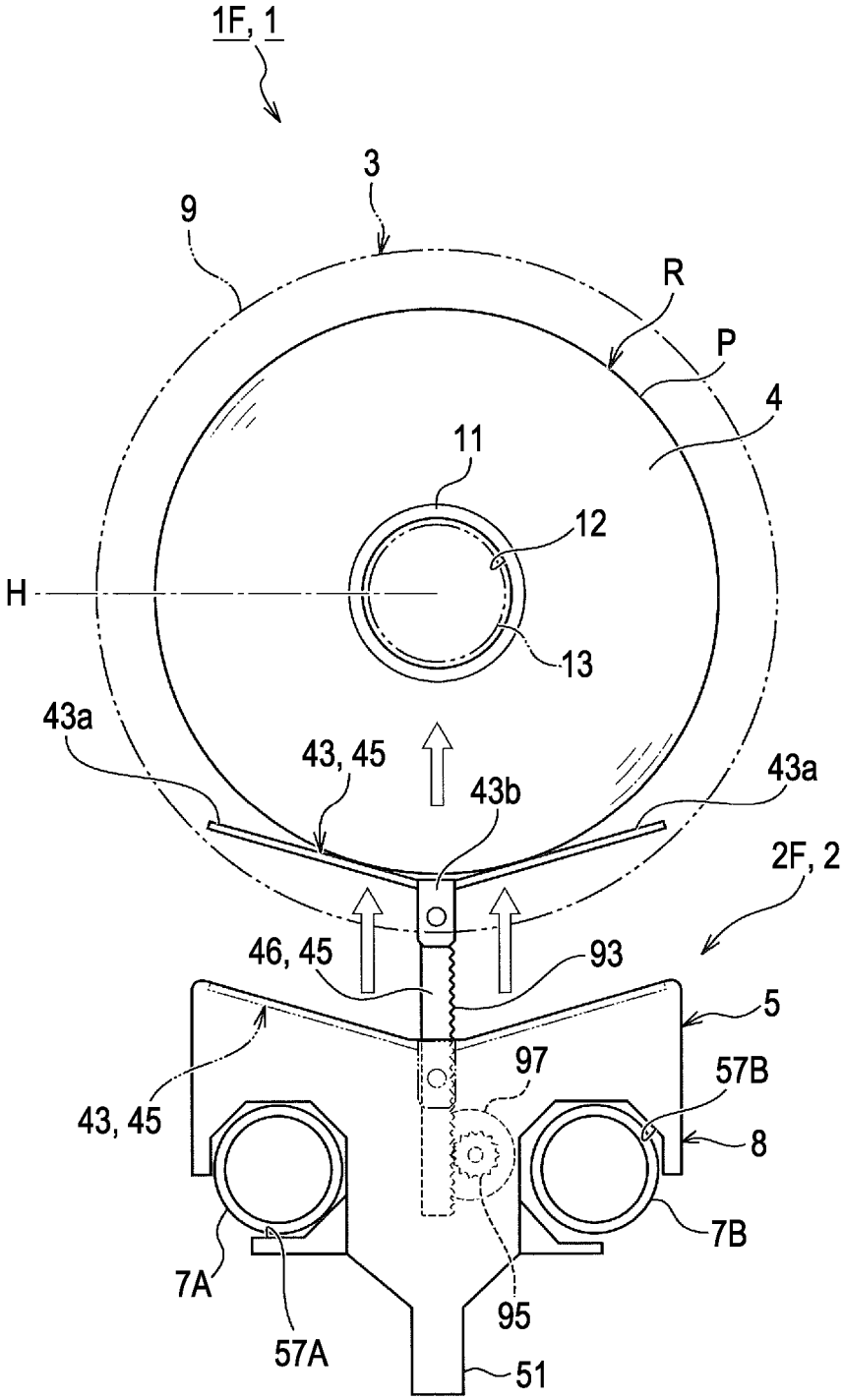
FIG. 11 is a side view illustrating a lifting device according to another embodiment of the invention.

To be more specific, as illustrated in FIG. 11, a rack-and-pinion mechanism in which a rack 93 is engraved on one face of the rod member 46 of the elevating portion 45 and a pinion gear 95 which is engaged with the rack 93 is attached to an output shaft of a motor 97 so as to move up and down the elevating portion 45, or the like, can be applied.

In addition, a positon of the fulcrum O of the operation lever 47 is not limited to the position on the rod 7B and can be set to an arbitrary position on the rod holder 8.

What is claimed is:

1. A recording apparatus comprising:

a roll paper holder including a shaft portion which holds a roll paper such that the roll paper is capable of being fed;

at least two rods which are arranged in parallel in a paper width direction;

a slide portion which is attached to the rods in a slidable manner and on which the roll paper is capable of being temporarily placed, wherein a space is formed between the roll paper in a state of being temporarily placed on the slide portion and the rods; and a roll paper lifting device which includes a placement portion on which the roll paper is placed, and lifts the roll paper to a height position of the shaft portion of the roll paper holder while the roll paper in the temporarily placed state is placed on the placement portion so as to position a core port of a roll core of the roll paper and the shaft portion, wherein the roll paper lifting device includes:

an elevating portion which has the placement portion and is capable of elevating in an up-down direction;

an operation lever which is rotationally movable about a fulcrum, and a driving force transmission mechanism which converts rotational movement of the operation lever in an up-down direction to up-down movement of the elevating portion and transmits a driving force at a position of the operation lever, which is closer to the fulcrum.

2. The recording apparatus according to claim 1, wherein the placement portion of the roll paper lifting device is configured such that a position of a placement face of the placement portion when the elevating portion is located at a lower limit position in a range where the elevating portion moves up and down is identical to a position of a temporal placement face of the slide portion.

3. The recording apparatus according to claim 1, wherein the roll paper lifting device is configured such that:

a position of an upper face of the slide portion is located at a position lower than uppermost points of the rods, and the placement portion is moved to the upper side from the position lower than the uppermost points of the rods with respect to the slide portion and lifts an end of the roll paper which is temporarily placed on the rods.

4. The recording apparatus according to claim 1, wherein the placement portion is configured so as to be swingable in accordance with an inclination posture of the roll paper.

5. The recording apparatus according to claim 1, wherein the roll paper holder is attached to a supporting main body of the roll paper holder through an adjusting portion which enables an angle of the shaft portion variable in accordance with an inclination posture of the roll paper.

6. The recording apparatus according to claim 1, wherein the elevating portion includes:

the placement portion; and a rod member which is provided so as to extend to the lower side from the placement portion, and the rod member is guided by a guiding portion provided on the slide portion so that the elevating portion is moved up and down in the vertical direction.

* * * * *